United States Patent [19]

Ahlf et al.

[11] Patent Number: 4,696,076

[45] Date of Patent: Sep. 29, 1987

[54] VACUUM CLEANER NOZZLE

[75] Inventors: Heinz-Jürgen Ahlf, Bergisch-Gladbach; Wieland Gühne, Remscheid; Hans-Peter Simm, Wuppertal; Peter Wulf, Ennepetal, all of Fed. Rep. of Germany

[73] Assignee: Vorwerk & Co. Interholding GmbH, Wuppertal, Fed. Rep. of Germany

[21] Appl. No.: 845,174

[22] Filed: Mar. 27, 1986

[30] Foreign Application Priority Data

Mar. 27, 1985 [DE] Fed. Rep. of Germany ... 8509150[U]

[51] Int. Cl.[4] ..... A47L 9/02

[52] U.S. Cl. ..... 15/415 R; 15/359; 15/410

[58] Field of Search ..... 15/410, 415 R, 377, 15/359

[56] References Cited

U.S. PATENT DOCUMENTS

| | | | |
|---|---|---|---|
| 1,953,944 | 4/1934 | Becker | 15/410 X |
| 3,011,188 | 12/1961 | Menche | 15/377 X |
| 3,291,540 | 12/1966 | Doersam | 15/410 X |
| 3,908,223 | 9/1975 | Brooks et al. | 15/410 X |
| 4,307,485 | 12/1981 | Dessig | 15/377 X |
| 4,423,534 | 1/1984 | Lyman et al. | 15/410 |
| 4,457,042 | 7/1984 | Jones et al. . | |

*Primary Examiner*—Chris K. Moore

*Attorney, Agent, or Firm*—Walter Ottesen

[57] ABSTRACT

The invention relates to a vacuum cleaner nozzle that is provided with a latching device between the attachment stub and the nozzle housing. These elements are latched together in a defined swivelling range in such a way that they perform a common synchronized swivelling movement. The elements can be unlatched again by overcoming the action of a spring-loaded latching bolt.

5 Claims, 4 Drawing Figures

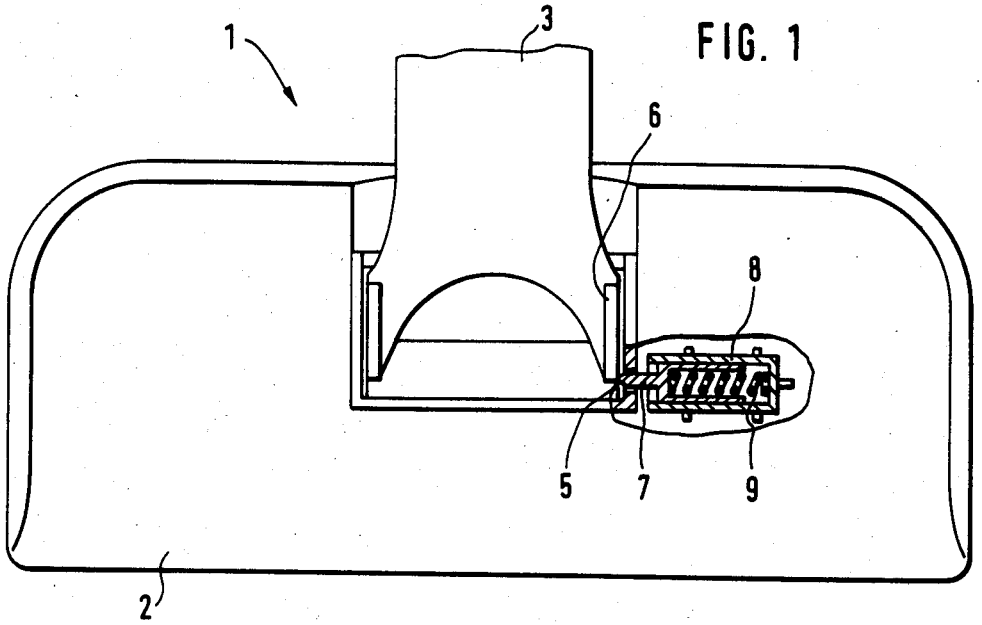
FIG. 1
FIG. 2
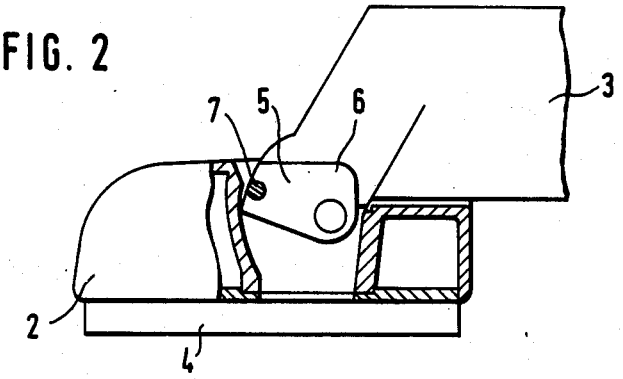

VACUUM CLEANER NOZZLE

FIELD OF THE INVENTION

The invention relates to a vacuum cleaner nozzle having an attachment stub that is pivotally supported in the nozzle housing.

BACKGROUND OF THE INVENTION

Vacuum cleaner nozzles of this type are the state of the art. A pivotable attachment stub is necessary so that as the vacuum cleaner is moved back and forth during use, the bottom plate of the vacuum cleaner nozzle can be kept parallel to the floor surface. Furthermore, it must also be possible to vacuum underneath low pieces of furniture. To accomplish this, the attached hand vacuum cleaner or the suction pipe of a larger vacuum cleaner must be placed in an extremely flat position. This would be impossible without pivotable attachment pipes.

Since all these vacuum nozzles rest close to the floor surface with their bottom plate, so as to generate a high air speed in the channels typically provided in the bottom plate and thus promote a good suction action, difficulties nevertheless arise in aspirating relatively large particles of dirt, which because of their size cannot be drawn through the suction channels.

To remove such larger particles, the vacuum cleaner nozzle and its bottom plate must be raised from the floor, so as to allow unhindered access by these larger dirt particles to the usually centrally located suction opening. This is not overly difficult to do when using the suction pipe of a vacuum cleaner large enough to rest on the floor, but strenuous effort is needed when using a hand vacuum cleaner. In this case, the user must lift the entire weight of the hand vacuum cleaner, in order to lift the vacuum cleaner nozzle and its bottom plate from the floor.

SUMMARY OF THE INVENTION

It is an object of the invention to provide a vacuum cleaner nozzle with a device that enables aspirating relatively large dirt particles without having to raise the vacuum cleaner nozzle together with the vacuum cleaner from the floor.

This object is attained by providing a detent device between the pivotable attachment stub and the nozzle housing which latches these elements together such that a single swivelling movement is performed.

Thus, the invention affords the advantage that vacuum cleaner nozzles can be provided with a device with which relatively large dirt particles can be aspirated, without requiring the exertion of force for raising an attached vacuum cleaner.

BRIEF DESCRIPTION OF THE DRAWING

The invention will now be described with reference to the drawing wherein:

FIG. 1 is a top plan view of a vacuum cleaner nozzle with a portion broken out to show the detent device in the unlatched condition;

FIG. 2 is a side elevation view of FIG. 1 partially cut away to show a portion of the detent device;

DESCRIPTION OF THE PREFERRED EMBODIMENT OF THE INVENTION

Figure 3:
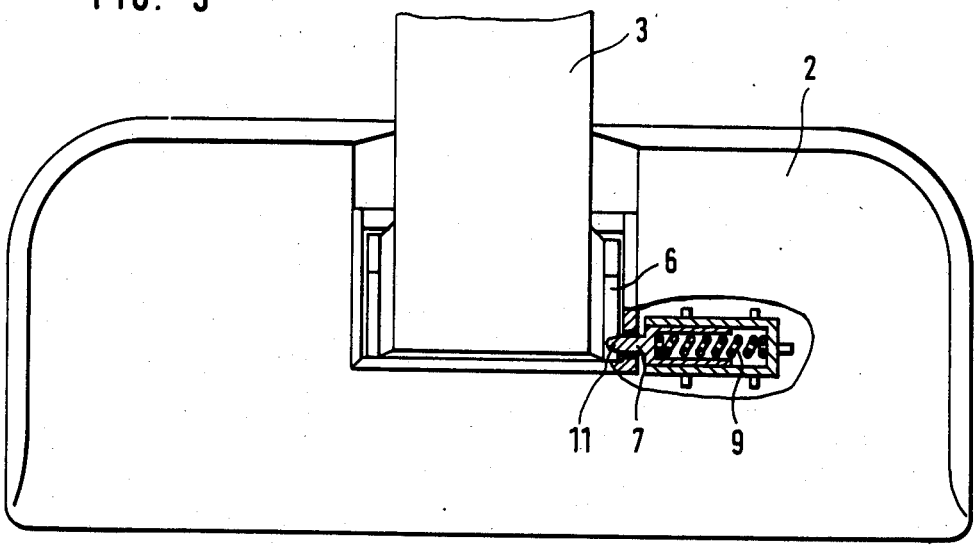
FIG. 3 is a plan view of the vacuum cleaner nozzle with a portion cut away to show the detent device in the latched condition; and, FIG. 4 is a side view of FIG. 3 partially cut away to show a portion of the detent device.

In FIG. 1, a vacuum cleaner nozzle 1 is shown which has an attachment pipe stub 3 pivotally mounted in the nozzle housing 2. A bottom plate 4 is disposed on the bottom of the nozzle housing 2 (see FIG. 2).

FIGS. 1 and 2 show that the attachment stub 3 has an abutment face 5 and an indented step 6; depending upon the angle of the swivelling movement of the attachment stub 3, the step 6 moves into the vicinity of a bolt 7 that is movably supported in the nozzle housing 2.

The bolt 7 is located in a guide sleeve 8 and is provided with a compression spring 9.

Figure 4:
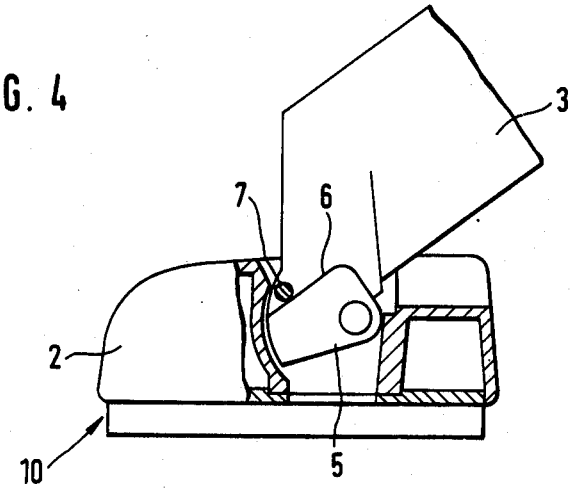

In FIGS. 1 and 2, this bolt 7 rests against the abutment face 5, and the suction pipe 3 can be swivelled virtually through its entire pivoting range, until it is moved into the position shown in FIGS. 3 and 4.

Here, the bolt 7 reaches the vicinity of the step 6, and the compression spring 9 presses the bolt 7 into this step 6. This latches the nozzle housing 2 and the attachment stub 3 together such that the front edge 10 of the nozzle housing 2 lifts by the same amount that the attachment stub 3 is swivelled. It is thus possible for larger dirt particles to be aspirated.

In order to reestablish the unlatched condition for normal use, the operator must exert force on the nozzle housing 2, for instance by using the foot, and simultaneously swivel the attachment stub 3 downwardly. Because of the conical configuration of the bolt tip 11, the bolt 7 then slips back over the step 6, counter to the force of the compression spring 9, and against the abutment face 5. "Normal" use of the vacuum cleaner is now once again possible.

It is understood that the foregoing description is that of the preferred embodiments of the invention and that various changes and modifications may be made thereto without departing from the spirit and scope of the invention as defined in the appended claims.

What is claimed is:

1. A vacuum cleaning nozzle for attachment to vacuum generating means, the vacuum cleaning nozzle comprising:

a housing;

an attachment stub for attachment to the vacuum generating means, said attachment stub being pivotally mounted in said housing for movement in a plane through an angle between a first angular position and a second angular position defining an end region of said movement;

detent means arranged on said nozzle so as to interface between said housing and said attachment stub for latching said attachment stub to said housing when the latter is pivotally moved to said second angular position so that a swivelling of said attachment stub causes said housing to be swivelled therewith; and, said detent means including a movable member movably journalled in said housing so as to be movable transversely to said plane for latching said stub to said housing; and, cam means conjointly defined by said movable member and said attachment stub responsive to a force tending to move said attachment stub out of said second position thereby unlatching said stub from said housing.

2. A vacuum cleaning nozzle for attachment to vacuum generating means, the vacuum cleaning nozzle comprising:

a housing;

an attachment stub for attachment to the vacuum generating means, said attachment stub being pivotally mounted in said housing for movement in a plane through an angle between a first angular position and a second angular position defining an end region of said movement;

detent means arranged on said nozzle so as to interface between said housing and said attachment stub for latching said attachment stub to said housing when the latter is pivotally moved to said second angular position so that a swivelling of said attachment stub causes said housing to be swivelled therewith; and, said detent means including: a pin-like member movably journalled in said housing so as to be movable transversely to said plane for latching said stub to said housing; said attachment stub having an abutment surface formed thereon for receiving said pin-like member thereagainst during said movement of said attachment stub up to said second position; said abutment surface having receiving means formed therein for engaging said pin-like member to latch said housing to said attachment stub when said attachment stub is pivoted into said second position; and, cam means formed at the interface of said pin-like member and said receiving means responsive to a force tending to move said attachment stub out of said second position thereby unlatching said stub from said housing.

3. The vacuum cleaning nozzle of claim 2, comprising means for resiliently biasing said pin-like member against said abutment surface.

4. A vacuum cleaning nozzle for attachment to vacuum generating means, the vacuum cleaning nozzle comprising:

a housing;

an attachment stub for attachment to the vacuum generating means, said attachment stub being pivotally mounted in said housing for movement in a plane through an angle between a first angular position and a second angular position defining an end region of said movement; and, detent means arranged on said nozzle so as to interface between said housing and said attachment stub for latching said attachment stub to said housing when the latter is pivotally moved to said second angular position so that a swivelling of said attachment stub causes said housing to be swivelled therewith; and, said detent means including: a movable member movably journalled in said housing so as to be movable transversely to said plane between a disengaged position and an engaged position for latching said stub to said housing;

biasing means for resiliently biasing said movable member into said engaged position;

said attachment stub having an abutment surface formed thereon for receiving said member thereagainst during said movement of said attachment stub up to said second position;

said abutment surface having receiving means formed therein for receiving and engaging said movable member in said engaged position thereof to latch said housing to said attachment stub when said attachment stub is pivoted into said second position; and, cam means formed at the interface of said member and said receiving means responsive to a force tending to move said attachment stub out of said second position thereby displacing said movable member to said disengaged position and unlatching said stub from said housing.

5. The vacuum cleaning nozzle of claim 4, said receiving means being a depressed step formed in said abutment surface for engaging said movable member when the latter is in said engaged position.

* * * * *